US009322117B2

(12) United States Patent
Salmela et al.

(10) Patent No.: US 9,322,117 B2
(45) **Date of Patent: *Apr. 26, 2016**

(54) METHOD AND APPARATUS FOR PRODUCING FIBRE YARN

(71) Applicant: Spinnova Oy, Jyvaskyla (FI)

(72) Inventors: Juha Salmela, Vtt (FI); Thomas Widmaier, Aalto (FI); Petri Kuosmanen, Aalto (FI); Panu Kiviluoma, Aalto (FI); Johanna Liukkonen, Vtt (FI); Hans Koskinen, Aalto (FI); Tuomas Stark, Aalto (FI); Tuomas Isomaa, Aalto (FI); Jyri Lehto, Aalto (FI)

(73) Assignee: SPINNOVA OY, Jyvaskyla (FI)

( * ) Notice: Subject to any disclaimer, the term of this patent is extended or adjusted under 35 U.S.C. 154(b) by 0 days.

This patent is subject to a terminal disclaimer.

(21) Appl. No.: 14/683,169

(22) Filed: Apr. 10, 2015

(65) Prior Publication Data

US 2015/0292121 A1 Oct. 15, 2015

(30) Foreign Application Priority Data

Apr. 15, 2014 (FI) ..... 20145360

(51) Int. Cl.
*D01H 4/16* (2006.01)
*D01H 4/32* (2006.01)

(52) U.S. Cl.
CPC ... *D01H 4/16* (2013.01); *D01H 4/32* (2013.01)

(58) Field of Classification Search
CPC ..... D02G 3/02; D01H 1/006; D01H 4/16; B29C 47/0014; D21F 9/003; D21F 11/002
See application file for complete search history.

(56) References Cited

U.S. PATENT DOCUMENTS 3,494,118 A 2/1970 Bobkowicz et al.
3,594,865 A * 7/1971 Erb ..... A44B 18/0049 425/113
5,489,365 A * 2/1996 Wahlstrom ..... D21F 9/006 162/203
6,136,153 A 10/2000 Rokman et al.
6,141,833 A * 11/2000 Sorensen ..... D01G 25/00 19/161.1

(Continued)

FOREIGN PATENT DOCUMENTS

CN 101724931 A 6/2010
CN 102912622 A 2/2013

(Continued)

OTHER PUBLICATIONS

Finland Office Action mailed Dec. 12, 2014, for corresponding patent application No. 20145360.

(Continued)

*Primary Examiner* — Shaun R Hurley
(74) *Attorney, Agent, or Firm* — Young & Thompson

(57) ABSTRACT

A method and apparatus for producing fibre yarn is provided. The novel apparatus includes a first transportation and pressing element (1) and a second transportation and pressing element (5) arranged adjacent to the first transportation and pressing element (1) as well as elements for driving the transportation and pressing elements (1, 5). The first and second transportation and pressing elements (1, 5) are arranged to form a nip therebetween. The apparatus also includes a nozzle (9) for feeding fibre suspension (6), such as pulp fibre suspension, to the nip between the first and second transportation and pressing elements (1, 5).

26 Claims, 3 Drawing Sheets

(56) References Cited

U.S. PATENT DOCUMENTS

| | | | | |
|---|---|---|---|---|
| 2006/0042049 | A1* | 3/2006 | Petersen | D04H 13/005 19/296 |
| 2015/0292122 | A1* | 10/2015 | Salmela | D01H 4/32 57/412 |

FOREIGN PATENT DOCUMENTS

| | | | |
|---|---|---|---|
| DE | 19544097 | C1 | 7/1997 |
| EP | 1493753 | A1 | 1/2005 |
| EP | 1493859 | A2 | 1/2005 |
| JP | 11198236 | A | 7/1999 |
| JP | 2004339650 | A | 12/2004 |
| JP | 4004501 | B2 | 9/2005 |
| JP | 4839973 | B2 | 12/2007 |
| WO | 0159209 | A1 | 8/2001 |
| WO | 2009028919 | A2 | 3/2009 |
| WO | 2013034814 | A1 | 3/2013 |

OTHER PUBLICATIONS

International Search Report and Written Opinion mailed Jun. 22, 2015 in counterpart International Patent Application No. PCT/FI2015/050248.

* cited by examiner

METHOD AND APPARATUS FOR PRODUCING FIBRE YARN

TECHNICAL FIELD

The present invention concerns a method and apparatus for producing fibre yarn by first extruding a fibre suspension through a nozzle, removing excess water, and finally, by drying the yarn.

Especially an embodiment of the invention concerns a method and apparatus for dewatering the yarn and for twisting the yarn from extruded suspension to dried yarn.

BACKGROUND

Many different types of yarns made of natural fibers are known in the art. One well known example is paper yarn, which is traditionally manufactured from paper sheets. The first and only industrial method was developed in the late 19th century in Germany. It has been refined over time but the basic principle has remained the same and it is still in use today. Typically, paper manufactured from chemical, mechanical or chemi-mechanical pulp is slit to strips (width typically from 5 to 40 mm), which are twisted to thread. Said thread may be subjected to dyeing and finishing. The product (paper yarn) has limited applications because of deficiencies in its properties, such as limited strength, unsuitable thickness, layered or folded structure, and further, the manufacturing method is inefficient.

Cotton is very widely used as raw material in the manufacture of yarns and ropes. However, the cultivation of cotton requires significant water resources and it is widely carried out in regions where there is shortage of water and food. When available water is used for the irrigation of cotton fields, the situation with regard to food supply becomes worse. Thus the use of cotton does not support sustainable development, and there is a need for alternative sources of fiber, suitable for replacing cotton at least partly.

Cotton farming covers 5% of the world's farming area but it uses 11% of all agrochemicals. Intensive farming of cotton has caused pollution to the waters, wear of the soil and it has changed the animal population. In the future highly pollutant cotton can be replaced by cellulose based materials. There are already alternatives to cotton. Rayon is a material produced from cellulose fibers but it still requires heavy chemical treatments.

Methods for producing fibre yarn and other products from cellulosic materials are described in documents JP 4004501 B, JP 10018123, JP 2004339650, JP 4839973, EP 1493859, CN 102912622, CN 101724931, WO 2009028919 and DE 19544097. The methods described usually include chemical treatment of cellulose before or during manufacture of the product.

SUMMARY OF INVENTION

Production of yarn directly from fibres, such as pulp fibres, without a dissolution process or disintegration of the fibres to nanofibres would increase the efficiency and ecofriendliness of the yarn manufacturing process. It would also decrease the raw material cost significantly. Currently there is no industrial scale fibre yarn manufacturing process available for producing fibre yarn from said fibres. Fibre yarn products are produced of cotton yarn, different viscose process yarns etc. Currently there are many attempts to produce yarn from NFC.

For the above reasons, it would be beneficial to provide a method and apparatus for producing yarn directly from cellulose fibres in a manner that is commercially exploitable in industrial scale.

In a first aspect, the invention relates to a method/apparatus for taking advantage of new material by forming it mechanically into a yarn and enabling of producing environmentally friendly material which can substitute cotton and rayon.

Generally speaking the object of the invention is achieved by a novel method and apparatus as defined by the claims.

One embodiment of the invention provides a device and method that can produce cellulose based yarn continuously.

According to other aspects and embodiments of the present invention, the invention provides a yarn product that is cheaper than comparative product made of cotton.

According to one further aspect of the invention, the invention provides new use of wood and other vegetable fibres.

An embodiment of the invention is based on feeding pulp fibre suspension, such as pulp fibre suspension, from a nozzle on a first wire sieve, transporting the suspension on the first sieve to a nip formed by the first and a second sieve having a machine travel direction different from that of the first sieve for twisting and rotating the yarn to be formed between the wire sieves.

According to one embodiment, the relative machine travel directions of the at least two sieves is adjustable.

According to one embodiment, the gap between the at least two wire sieves narrows in the machine travel direction.

According to one embodiment of the invention, the gap between the at least two wires is adjustable.

According to one embodiment of the invention, at least one vacuum suction box is arranged on opposite side of at least one of the wires in relation of the wire gap.

According to one embodiment of the invention, the apparatus is equipped with at least one heating element for drying and treating the yarn to be manufactured.

The various embodiments of the invention provide essential benefits.

New method described herein for producing cellulose based yarn is cleaner to the environment compared to, for example, use of cotton and it can use harvesting surplus of wood and other cellulosic plant material. Finland's harvesting surplus of cellulosic material alone could replace 20% of the world's cotton demand. This device enables industrial scale fibre yarn production using technologies currently available in pulp and paper industry. The invention provides a possibility to create new field of industry and open totally new uses to northern wood fibres.

By the method and apparatus of the invention a fibre yarn can be made of pulp mass that need not be excessively chemically or mechanically processed. The fibre yarn can be used to replace yarn made of other materials. Further, the yarn can be used in new applications utilizing characteristic properties of the fibre yarn such as twistability. The fibre yarns can be recycled several times just like paper or board. The fibre material of the fibre yarn can be sourced from several sources. Wood fibre is suitable but also fibre materials used for manufacture of paper or board can be used as raw materials. The twisting to the yarn inherent for the inventive method increases the strength and elasticity of the yarn as it increases contacts between the fibres in the yarn, i.e. cross linking.

Other objects and features of the invention will become apparent from the following detailed description considered in conjunction with the accompanying drawings. It is to be understood, however, that the drawings are intended solely for purposes of illustration and not as a definition of the limits of the invention, for which reference should be made to the appended claims.

DESCRIPTION OF EMBODIMENTS

Definitions

Machine travel direction is the direction the sieve wires over their operating zone. Return travel direction is the direction on which the sieve wire loop runs on return side.

Operating zone of the wire sieve is the part of the sieve wire loop on which the yarn to be manufactured travels when it is processed.

Centerline of the wire is the centerline of that part of the wire loop on which the yarn to be manufactured travels when it is processed.

Pulp is considered to be mechanical, chemi-mechanical or chemical pulp mass wherein fibres have not been dissolved or disintegrated to nanofibres.

Starting point for this invention is a new method for the manufacture of fibrous yarn for connecting cellulose fibers to solid material. The method is disclosed in WO 2013/034814, which is included herein as reference. The main application for the material was the producing of the yarn by connecting fibers continuously together.

Main functions of this device are dewatering and forming of the cellulose yarn. Based on experiences from manual laboratory scale manufacturing moisture and excess water should be compressed out of the yarn while the yarn is simultaneously twisted to achieve the final form and to maintain the round cross section of the yarn during pressing.

According to the invention the pulp fibre suspension, such as pulp fibre suspension, is extruded between two angled wire sieves and the compression of wire sieves dewater the yarn and angular force element rotates and twists the yarn and the yarn will achieve its final form. The final result would resemble ordinary cotton yarn.

The proper parameters for producing the yarn such as speed, pressure and rotating angle affect to the quality and properties of the yarn. Other significant parameters include the angle of the nozzle, the speed difference between the respective speeds of the sieve and the fiber suspension 13, which speed difference results in the stretching of the yarn, as well as speed difference between the respective speeds of formation part and drying part.

Figure 1:
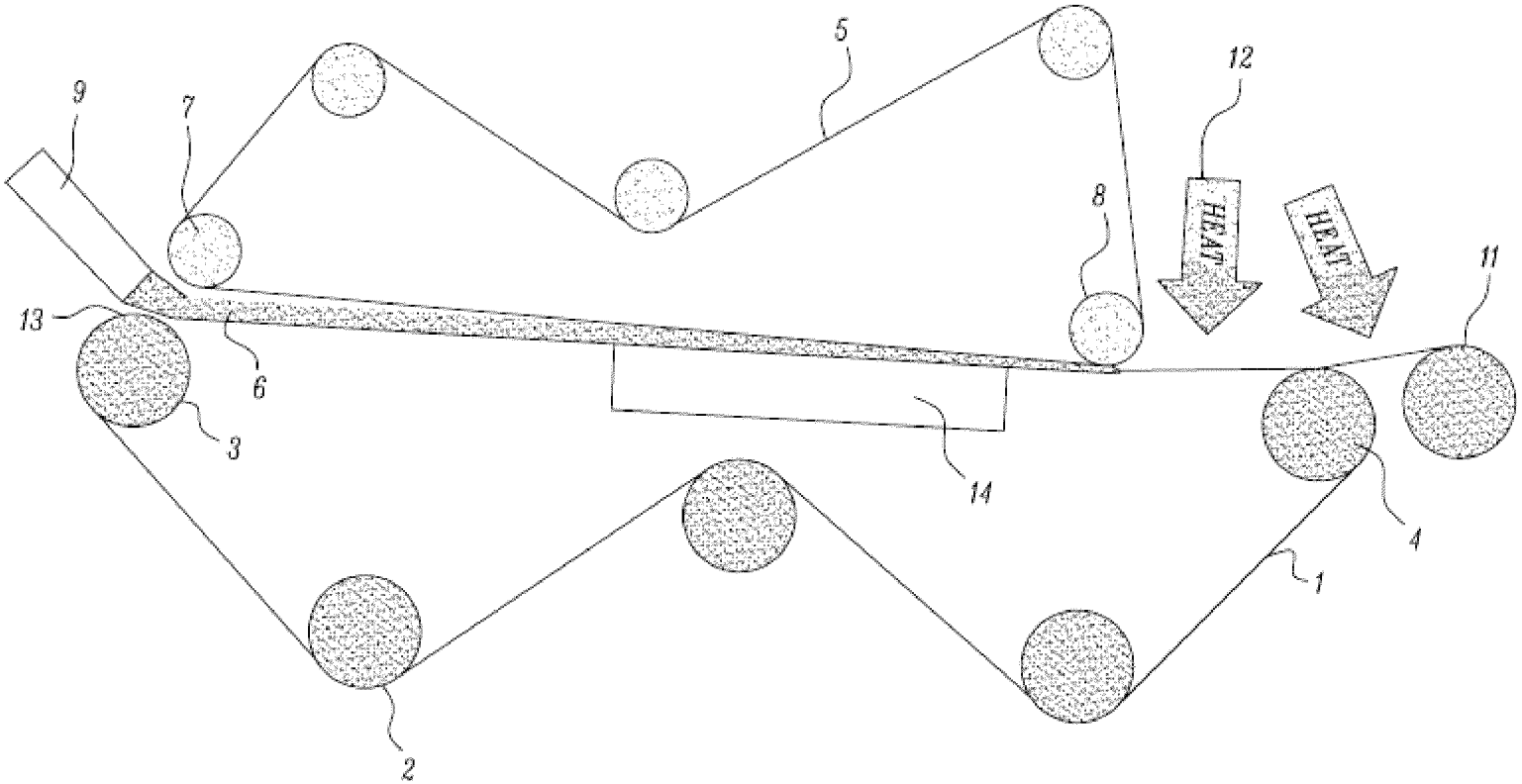
FIG. 1 is a schematic side view of one embodiment of the invention.

The embodiment in FIG. 1 comprises a first, lower sieve wire 1 arranged to run in a loop over guide rolls 2. On the loop is formed a straight part between first guide roll 3 and second guide roll 4. A second wire sieve 5 is arranged to run on a loop against the straight part of the first wire sieve 1 so that a gap 6 is formed between the wire sieves 1, 5. The gap between the two wire sieves 1, 5 is arranged to narrow in the machine travel direction by guiding the second wire sieve 5 by third and fourth guide roll. This provides a narrowing pressurized gap for removing water from the pulp fibre suspension. The wire sieves 1, 5 form a narrowing nip that is positioned to begin, in the machine travel direction, after the first guide roll 3 of the first wire sieve 1. The first guide roll 7 of the second wire sieve 5 is positioned downstream of the first guide roll 3 of the first wire sieve 1 so that that an open space is formed on the first wire sieve 1 on the distance between the first guide roll 3 of the first wire sieve 1 and the first guide roll 7 of the second wire sieve 5. The operation zone of the formed between the first and second guide rolls 3, 4 of the second wire sieve 1.

A nozzle 9 is positioned at the beginning of the operation zone of the apparatus over the open space of the first wire sieve 1 for feeding a pulp fibre suspension 13 on the first wire sieve 1. On the opposite end of the operation zone is winder roll 11 or corresponding winding apparatus for collecting the manufactured yarn. The second guide roll 8 of the second wire sieve 5 and the second guide roll 4 of the first wire sieve 1 are spaced apart so that open space is formed on the first wire sieve 1 between these guide rolls 4, 8. Over this space optional heaters 12 can be placed. Suitable heaters are infrared heaters, hot air dryers or other known dryers or heaters used for example in paper, pulp and board industry. A suction box 14 for removing water and moisture from the yarn through the wire sieve can be placed on opposite side of each wire sieve 1, 5 in relation to the yarn to be formed. In this example one suction box 14 is placed under the first wire sieve. The wire sieves 1, 5 and winder roll are rotated by driven guide rolls, for example by means of electric motors or corresponding actuators.

Yarn is manufactured by the above described apparatus by feeding pulp fibre suspension over the first wire sieve 1 so that the running wire sieve 1 transfers the suspension to the nip of first and second wire sieve 1, 5. In the gap the yarn to be formed is twisted and rotated and pressed against the surfaces of the wire sieves 1, 5. This action removes water effectively and forms a good quality yarn.

Figure 2:
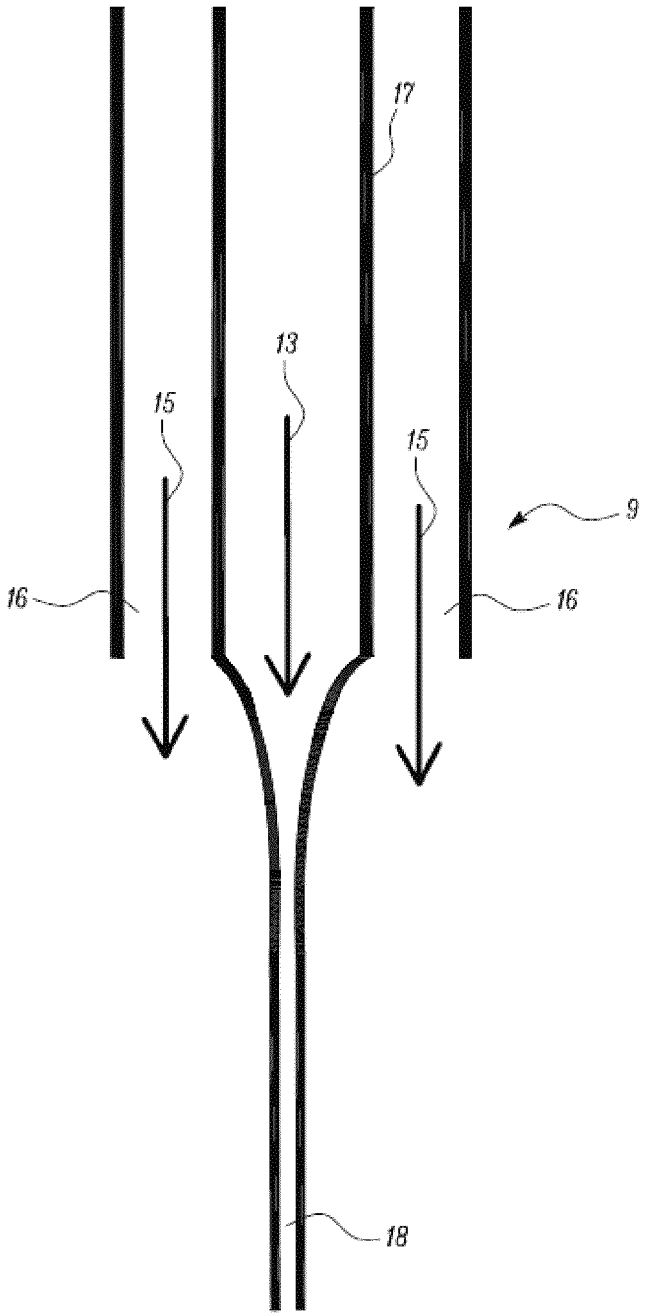
FIG. 2 is a schematic cross section of a nozzle that can be utilized for realizing the invention.

One embodiment of a nozzle suitable for implementing the invention is shown in FIG. 2, depicting a cross-section picture of a nozzle 9. In this embodiment a circular nozzle is shown. The fiber suspension 13 is fed through the inner die or orifice 17 and if salt or other chemicals 15 are used for crosslinking, they may be fed through outer die or orifice 16. Other cross-section geometries besides circular may as well be used, such as elliptical or rectangular. When the fibre suspension is pushed through the nozzle it has a velocity and narrow to a circular thin line 18 of fibre suspension. The diameter of the suspension line is defined by exit speed of the suspension 13 and speed of the first wire sieve 1 on which the suspension is fed.

Moist yarn obtained from the nozzle 9 initially contains water typically from 30 to 99.5% w/w. In the dewatering step the solid content of the yarn may be adjusted to desired level until all free water is removed.

The nozzle 9 forms a jet causing the gel formation. The nozzle is designed so that the flow accelerates and orients the fibres inside the nozzle. The crosslinking fluid merges with the fibre suspension outside the nozzle and the gel is formed. To maintain the round shape of the yarn in the wire section the yarn has to be twisted and rotated during the dewatering. This is done by tilting one of the wire sieves so that there is an angle difference in the wire machine direction alignment. Dewatering speed is adjusted by changing the wire gap 6 in machine direction and by vacuums. Jet to wire speed difference changes the tension and stretches the yarn. Wire tension and wire gap causes also pressing of the preformed yarn to the wires.

Figure 3:
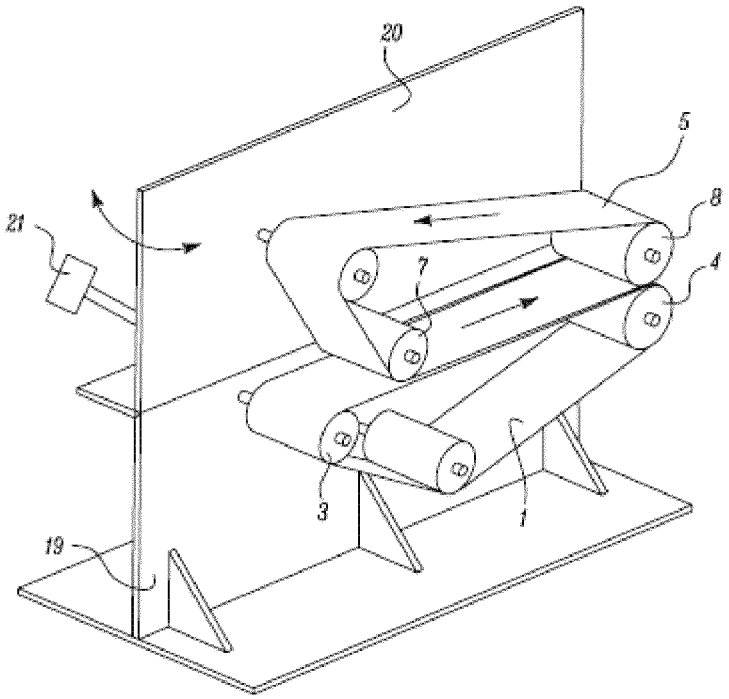
FIG. 3 is a schematic perspective view of one embodiment of the invention.

FIG. 3 shows one embodiment of the apparatus according to the invention. It must be noted that parts and designs not shown in FIG. 1 but shown in FIG. 3 should be considered to be present in both embodiments when functionally needed as some of the part s are shown only in one figure for clarity. In here, the first wire sieve 1 is guided by three guide rolls. These rolls are mounted on a fixed (lower) frame part 19. Second wire sieve 5 is mounted through its guide rolls to a movable (upper) frame part 20 that is movably mounted on the fixed frame part. An actuator 21 is used for adjusting the relative position of the movable frame part 20 and the fixed frame part 19. This allows for adjusting the relative positions of the wire sieves 1, 5.

The method and apparatus is most suitable for producing yarns using the teachings of WO 2013/034814 that discloses a method for producing cellulose based yarn. The results from earlier experiments show that material properties of this new type of cellulose yarn are promising and good quality yarn has already been made. Previous experiments are made in laboratory scale and produced yarns have not been long enough for making e.g. fabric out of them. This problem can be solved by means of the invention.

Initial shape of the yarn is achieved through fast suspension crosslinking right after the nozzle 9 before the suspension hits the wire. In the nozzle rheology modifiers prevent clogging and the fibres are oriented with the flow. Different compounds are pumped through the nozzle with synchronized speeds and as they get mixed, the crosslinking prevents further mixing and initial dewatering with gravity.

Wet gel yarn 18 is extruded directly to the first wire sieve 1, which conveys the material between first and second wire sieves 1, 5. When the preformed yarn encounters the second, in here upper, wire sieve 5, water begins to be pressed out of it. The diameter of yarn decreases when it moves along between the wire sieves 1, 5. Wire sieves 1, 5 are aligned so that the gap 6 between them decreases when approaching the output point and an angle difference in machine travel direction (X-Y) direction between the centerlines of the wire sieves 1, 5 rotates the yarn while pressing.

All free water is removed by pressing and twisting the yarn between the wire sieves 1, 5. At this point the strength of the yarn is sufficient for reeling and the final dewatering takes place there. Also further drying of the yarn may be included to this device as described in narration of FIG. 1.

Angular adjusting of the wires is implemented by two-pieced frame 19, 20. Fixed (lower) frame part 19 is solid and movable (upper) frame part 20 can be rotated as depicted by an arrow in FIG. 3. Movable frame part 20 rotates along two conductors and it is lockable. Conductors permit slight movements also in horizontal plane. It is clear that a person skilled in the art can design various options for implementing this relative movement.

Frame of the device is designed to be easy to adjust and maintain.

The frame of the device is required to have high stiffness because rolls are attached only from one end and they must stay well aligned to get the yarn to uniform quality. Adding features and modifying the placement of the rolls for possible upcoming needs should be easy. It is clear that construction of the frame is not limited to the example shown.

The speeds of the wire sieves 1, 5 are preferably accurately adjustable to get the operating speed synchronized with the pump that is feeding the material through the nozzle 9. The operation of wire sieves can be accomplished individually with two PC controlled AC servo motors. The velocities can be automatically synchronized to each other by giving the amount of deviation in angularity of wires.

A fully functional and highly adjustable device for dewatering and forming cellulose yarn can be designed and manufactured according to the invention.

Main production parameters that effect each parameter on the form of yarn are wire sieve speed, rotating angle (angle between the wire sieves) and space between the upper (second) and the lower (first) wire. By changing the wire sieve angle in X-Y plane the force rotating the yarn at horizontal plane is changed. Gap between the wire sieves affect the compression pressure and it can also change the yarn rotation by changing friction force.

In a fully operating manufacturing facility it would be foreseeable to arrange a plurality of parallel nozzles to produce yarn on several production lines simultaneously. After the production stage described above with reference to FIGS. 1 to 3 the simultaneously produced plurality of yarns may be wound together to form one or several thick yarn(s). Such a thick yarn consisting of said individual yarn may then be wound to a roll with or without a supplementary treatment stage of applying suitable chemicals for a particular desired effect.

Rough adjusting for these parameters can be based on results of visual inspection of the yarn. The main goal of the invention is to produce yarn continuously. The specific properties of yarn (constant diameter, tensile strength) can be adjusted by changing operating parameters. The results of the preliminary tests run on the invention were promising and established solid basis for future research.

The purpose of the invention is to provide a device to continuously produce yarn directly from a fibre suspension, preferably pulp fibre suspension. The way of turning fibre suspension into a yarn is completely new.

The device can be easily adjusted to manufacturing needs. The apparatus according to the invention can produce cellulose yarn continuously at very high speeds. Even higher speeds than 10 m/s are possible but then at least motors and drive pulleys needs to be dimensioned and chosen accordingly.

It can be contemplated that the angle and distance of the wires could be accurately adjustable by a computer while the process is ongoing for producing even longer and better shaped yarn. Further, the speed of the wire sieves may be same or different in relation to each other. Speed differences may be utilized for affecting the surface structure and twisting of the yarn, for example.

The invention utilizes preferably liquid penetrable wires, felts or belts as transfer and pressing elements. However, rubber or plastic bands or similar non-penetrable bands might also be used if water removal from the gap between the transfer and pressing elements is arranged, for example by suction. One alternative is use penetrable/non-penetrable pair of transfer and pressing elements.

With similar treatments as used with cotton yarn, cellulose yarn can reach comparable properties to cotton and can be utilized in fabrics. Raw cellulose material costs less than cotton which makes it also economically interesting. In addition, cellulose yarn is environmentally friendly. Raw material for cellulose can be gathered for example from harvesting surplus.

Thus, while there have been shown and described and pointed out fundamental novel features of the invention as applied to a preferred embodiment thereof, it will be understood that various omissions and substitutions and changes in the form and details of the method and device may be made by those skilled in the art without departing from the spirit of the invention. For example, it is expressly intended that all combinations of those elements and/or method steps which perform substantially the same results are within the scope of the invention. Substitutions of the elements from one described embodiment to another are also fully intended and contemplated. It is also to be understood that the drawings are not necessarily drawn to scale but they are merely conceptual in nature. It is the intention, therefore, to be limited only as indicated by the scope of the claims appended.

The invention claimed is:

1. A method for producing fiber yarn, the method comprising:

feeding a fiber suspension from a nozzle by feeding the fiber suspension to a nip formed by a first transportation and pressing element and a second transportation and pressing element, and twisting and rotating the fiber suspension to create the fiber yarn.

2. The method according to the claim 1, further comprising pressing the yarn to be formed between the transportation and pressing elements, the transportation and pressing elements being liquid penetrable.

3. The method according to the claim 1, further comprising pressing the yarn to be formed between the transportation and pressing elements, the transportation and pressing elements being liquid non-penetrable.

4. The method according to claim 1, wherein one of the first and second transportation and pressing elements is liquid penetrable, and the other of the first and second transportation and pressing elements is liquid non-penetrable.

5. The method according to claim 1, wherein the transportation and pressing elements are configured to run so that the machine travel direction of the first transportation and pressing element is different from the machine travel direction of the second transportation and pressing element to twist and rotate the yarn to be formed between the transportation and pressing elements.

6. The method according to claim 1, wherein the relative machine travel directions of the transportation and pressing elements are adjusted.

7. The method according to claim 1, further comprising feeding the fiber suspension first on the first transportation and pressing element; and then transporting the suspension to the nip formed by the first and second transportation and pressing elements.

8. The method according to claim 1, wherein a gap is provided between the transportation and pressing elements that narrows in the machine travel direction.

9. The method according to the claim 8, further comprising adjusting the gap between the transportation and pressing elements.

10. The method according to claim 1, wherein at least one suction box is disposed on an opposite side of at least one of the transportation and pressing elements that is liquid penetrable in relation to a gap between the elements.

11. The method according to claim 1, further comprising heating the yarn to be formed with at least one heating element to dry and treat the yarn.

12. The method according to claim 1, further comprising controlling speeds of the transportation and pressing elements so that the elements are run on similar or different speeds.

13. The method according to claim 1, wherein the fiber suspension is a pulp fiber suspension.

14. An apparatus for producing fiber yarn, the apparatus comprising:

a first transportation and pressing element;

a second transportation and pressing element disposed adjacent to the first transportation and pressing element;

a driving a driving device configured to drive the transportation and pressing elements;

a nozzle configured to feed a fiber suspension to between the first and second transportation and pressing element the first transportation and pressing element and the second transportation and pressing element are disposed to form a nip therebetween into which the nozzle is configured to feed the fiber suspension, the fiber suspension being twisted and rotated by the apparatus to create fiber yarn.

15. The apparatus according to the claim 14, wherein at least one of the transportation and pressing elements is liquid penetrable.

16. The apparatus according to the claim 14, wherein at least one of the transportation and pressing elements is liquid non-penetrable.

17. The apparatus according to the claim 14, wherein one of the first and second transportation and pressing elements is liquid penetrable, and the other of the first and second transportation and pressing elements is liquid non-penetrable.

18. The apparatus according to claim 14, the transportation and pressing elements are configured so that the machine travel direction of the first transportation and pressing element is different from the machine travel direction of the second transportation and pressing element to twist and rotate the yarn to be formed between the transportation and pressing elements.

19. The apparatus according to claim 18, an adjuster is configured to adjust the relative machine travel directions of the transportation and pressing elements.

20. The apparatus according to claim 14, wherein the nozzle is configured to:

feed the fiber suspension first on the first transportation and pressing element, and the first transportation and pressing element transports the suspension to the nip formed by the first and second transportation and pressing elements.

21. The apparatus according to claim 14, wherein a gap is provided between the transportation and pressing elements.

22. The apparatus according to claim 21, wherein the gap narrows in the machine travel direction.

23. The apparatus according to claim 21, further comprising an adjuster configured to adjust the gap between the transportation and pressing elements.

24. The apparatus according to claim 14, further comprising at least one suction box disposed on an opposite side of at least one of the transportation and pressing elements that is liquid penetrable in relation to the gap between the transportation and pressing elements.

25. The apparatus according to claim 14, further comprising at least one heating element configured to dry and treat the yarn.

26. The apparatus according to claim 14, further comprising a controller controlling speeds of the transportation and pressing elements so that the elements are run on similar or different speeds.

* * * * *